US011084506B2

(12) United States Patent
Kondyra

(10) Patent No.: US 11,084,506 B2
(45) Date of Patent: Aug. 10, 2021

(54) ARTICULATED RAILWAY VEHICLE, WITH AN IMPROVED MODULARITY

(71) Applicant: ALSTOM Transport Technologies, Saint-Ouen (FR)

(72) Inventor: Emmanuel Kondyra, La Rochelle (FR)

(73) Assignee: ALSTOM TRANSPORT TECHNOLOGIES, Saint-Ouen (FR)

( * ) Notice: Subject to any disclaimer, the term of this patent is extended or adjusted under 35 U.S.C. 154(b) by 441 days.

(21) Appl. No.: 15/726,022

(22) Filed: Oct. 5, 2017

(65) Prior Publication Data

US 2018/0099682 A1 Apr. 12, 2018

(30) Foreign Application Priority Data

Oct. 7, 2016 (FR) ..... 16 59689

(51) Int. Cl.

| | |
|---|---|
| ***B61D 1/00*** | (2006.01) |
| ***B61D 3/10*** | (2006.01) |
| ***B61F 3/12*** | (2006.01) |
| ***B61F 5/16*** | (2006.01) |

(52) U.S. Cl.

CPC ..... *B61D 1/00* (2013.01); *B61D 3/10* (2013.01); *B61F 3/125* (2013.01); *B61F 5/16* (2013.01)

(58) Field of Classification Search

CPC ... B61D 1/00; B61D 3/10; B61F 3/125; B61F 5/16

See application file for complete search history.

(56) References Cited

U.S. PATENT DOCUMENTS

| | | | | |
|---|---|---|---|---|
| 1,754,111 | A | 4/1930 | Latshaw | |
| 2,087,377 | A | 7/1937 | Geissen | |
| 2,424,941 | A | 7/1947 | Musser et al. | |
| 2,505,183 | A * | 4/1950 | Henrichsen | B61D 3/10 105/200 |
| 2,865,306 | A | 12/1958 | Bock et al. | |
| 3,875,869 | A * | 4/1975 | Molnar | B61D 1/00 105/1.4 |
| 5,009,169 | A * | 4/1991 | Viens | B61D 3/12 105/34.1 |
| 5,063,859 | A | 11/1991 | Rader | |
| 5,343,812 | A | 9/1994 | Ishida | |
| 2006/0260503 | A1 * | 11/2006 | Jeunehomme | B61F 3/125 105/4.1 |
| 2008/0190318 | A1 | 8/2008 | Palais et al. | |

(Continued)

FOREIGN PATENT DOCUMENTS

| | | |
|---|---|---|
| CN | 100422020 | 4/2006 |
| CN | 1882466 | 12/2006 |
| DE | 688777 | 3/1940 |

(Continued)

OTHER PUBLICATIONS

Preliminary Search Report for FR 1659689, dated Jun. 1, 2017.

*Primary Examiner* — Scott A Browne

(74) *Attorney, Agent, or Firm* — B. Aaron Schulman, Esq.; Stites & Harbison, PLLC

(57) ABSTRACT

The railway vehicle (10) includes a plurality of cars (12, 20) articulated to one another, the plurality of cars including:

a single first key car (12), having a first architecture, a plurality of second cars (20), having similar second architectures different from the first architecture.

The first key car (12) has no dining area.

11 Claims, 1 Drawing Sheet

(56) References Cited

U.S. PATENT DOCUMENTS

2017/0297590 A1* 10/2017 Bilstein-Hemmer .... B61D 1/00

FOREIGN PATENT DOCUMENTS

| | | |
|---|---|---|
| DE | 4442368 | 5/1996 |
| EP | 0537702 | 4/1993 |
| EP | 2314492 | 4/2011 |
| FR | 2874566 | 3/2006 |
| RU | 2520173 | 5/2011 |
| WO | WO-2005049400 | 6/2005 |

* cited by examiner

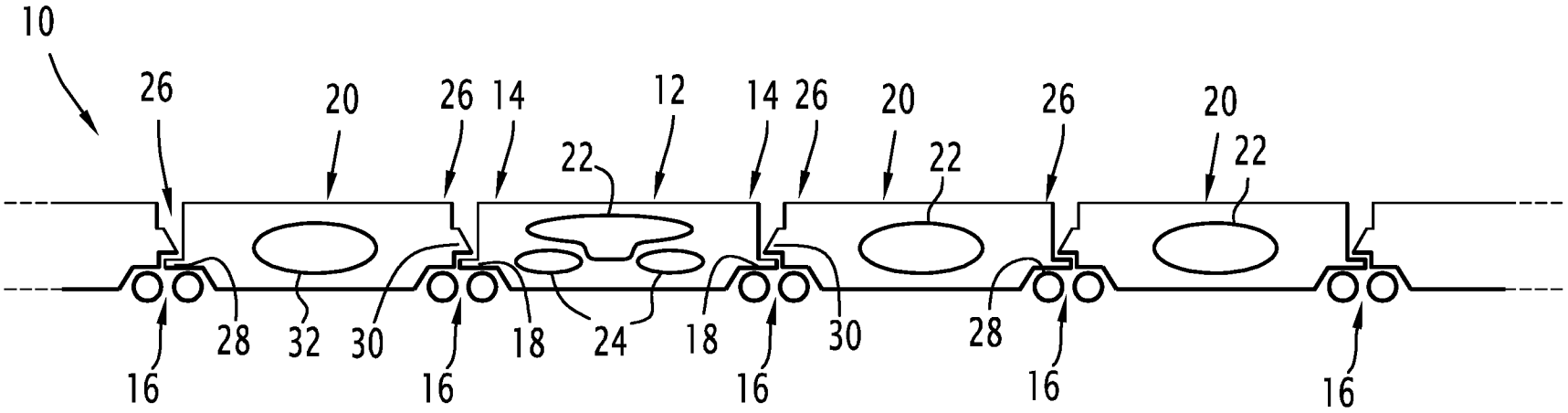
10
26
20
22
26
14
12
14
26
20
16
28
30
18
24
18
30
32
28

ARTICULATED RAILWAY VEHICLE, WITH AN IMPROVED MODULARITY

The present invention relates to a railway vehicle, in particular a long-distance train, for example a High Speed Train, of the type including a plurality of cars articulated to one another.

Two railway vehicle cars are said to be articulated to one another when they include, at each end, a bogie shared with another car. In other words, the shared bogie bears two adjacent cars.

A railway vehicle whereof all of the cars are articulated is said to have an articulated architecture.

Such a long-distance railway vehicle with an articulated architecture is assembled by first placing a first car, called key car, which is mechanically the first car of the vehicle to be mounted on its bogies.

The first key car is unique, and has a specific first structure, related to this key car function.

Two second cars are next articulated on this first key car, each respectively on either side of this first key car.

A plurality of other second cars are lastly assembled with the previous ones, each articulated with a second car already in place.

The second cars have second structures similar to one another, and different from the first structure.

In order to take advantage of these similar second structures, typically all of the second cars remain similar, for ease of manufacturing and cost-effectiveness reasons. To that end, all of the specific equipment is typically arranged on the first car.

This is in particular the case for a dining area, which is typically arranged in the first car.

A dining area refers to any area provided for passengers to dine, including:

- a preparation part, in which food and beverages are stored, prepared by a dining service person, and sold, generally at a bar, and
- a dining part, which is a room arranged specifically for dining, including tables and/or seats.

The present invention in particular aims to increase the modularity of such a railway vehicle with an articulated architecture.

To that end, the invention in particular relates to a railway vehicle, in particular a long-distance train, of the type including a plurality of cars articulated to one another, the plurality of cars including:

- a single first key car, having a first architecture,
- a plurality of second cars, having second architectures similar to one another and different from the first architecture, characterized in that the first key car has no dining area, and in that one of the second cars includes a dining area.

The present invention goes against the practice of the state of the art, which requires arranging all specific equipment, including the dining area, in the first car.

The invention provides for separating the key car function and the dining function, which makes it possible to increase the modularity of the vehicle, by offering, or not offering, a dining area, without the removal of such a dining area involving changes to the key car. It then suffices to replace a second car including the dining area with a second car have no dining area, or more simply eliminating the second car including the dining area, to do away with such a dining area.

A railway vehicle according to the invention may further include one or more of the following features, considered alone or according to all technically possible combinations.

- The first key car extends in a longitudinal direction between two first ends, its first architecture comprising, at each first end, support means for an adjacent second car.
- The first key car includes at least one passenger area and/or at least one equipment area.
- The first key car includes at least one equipment area in particular comprising a household refrigerating unit and/or an air conditioning unit.
- Each second car extends in a longitudinal direction between two second ends, its second architecture comprising, at one of its second ends, support means for another adjacent second car, and at the other of its second ends, means for connecting to support means for an adjacent first or second car.

The invention also relates to a method for manufacturing a railway vehicle as previously defined, including:

- producing a first key car, having a first structure, with no dining area,
- producing second cars, having second structures similar to one another and different from the first structure, one of the second cars including a dining area,
- placing the first key car,
- connecting the first key car with two of the second cars, respectively on either side of this first key car,
- adding a plurality of other second cars, each connected to another second car.

The invention will be better understood upon reading the following description, provided solely as an example and done in reference to the appended FIGURE, schematically and partially showing a railway vehicle with an articulated architecture according to one example embodiment of the invention.

The FIGURE shows a railway vehicle 10 according to one example embodiment of the invention.

The railway vehicle 10 is a long-distance train, in particular a High Speed Train. This vehicle may also be a regional train or a suburban train.

The railway vehicle 10 includes a unique first car 12, called first key car, having a first architecture.

The first key car 12 extends in a longitudinal direction between two first ends 14, each supported by a respective bogie 16.

The first architecture comprises, at each first end 14, support means 18 for an adjacent second car 20. Thus, the first architecture is globally symmetrical.

Based on the considered embodiment, the first key car 12 indifferently has one or two floors.

In all cases, the first key car 12 includes at least one passenger area 22 and/or at least one equipment area 24.

The equipment area 24 is intended to receive a maximum amount of specific technical equipment, i.e., unique for the vehicle 10 and not found in most of the cars of the vehicle 10. For example, the equipment area 24 in particular includes a household refrigerating unit and/or an air conditioning unit, etc.

In the case of a key car 12 with two floors, the passenger area 22 advantageously extends over the upper level as well as the lower level, and also in this case includes an area for accommodating passengers with reduced mobility. This area is specific and unique to the vehicle 10.

It should be noted that the first key car 12 has no dining area. Thus, the dining and key car functions are separated.

The railway vehicle 10 further includes a plurality of second cars 20, having second architectures similar to one another and different from the first architecture.

Each second car 20 extends in a longitudinal direction between two second ends 26, each supported by a respective bogie 16.

Each bogie 16 is shared by two first 12 or second 20 adjacent cars. In other words, the cars 12, 20 are all articulated to one another. The railway vehicle 10 is said to have an articulated architecture.

The second architecture of each second car 20 comprises, at one of its second ends 26, support means 28 for another adjacent second car 20, and at the other of its second ends 26, means 30 for connecting to support means 18, 28 of the first 12 or one of the second 20 adjacent cars. Thus, the second architecture is globally asymmetrical.

All of the connecting means 30 are connected to the respective support means 18, 28.

Advantageously, one of the second cars 20 includes a dining area 32. For example, this second car 20 including the dining area 32 is adjacent to the first key car 12.

The entire dining area 32 is provided for passenger dining, and includes a preparation part, in which food and beverages are stored, prepared by a dining service person, and sold, generally at a bar, and a dining area, which is a room specifically arranged for dining, including tables and/or seats.

The other second cars 20 each include at least one passenger room 22.

The second cars 20 indifferently have one or two floors, based on the considered embodiment.

It will be noted that the railway vehicle includes only one dining area, arranged in a second car 20, separate from the first key car 12.

Thus, if a dining area is not desired, this second car 20 including the dining area 32 can be removed, or replaced by a second car 20 including at least one passenger room 22. In this case, a railway vehicle 10 is obtained provided with no dining area, but keeping an unchanged first key car 12.

It will be noted that the railway vehicle 10 advantageously also includes third end cars (not shown), having a third structure different from the first and second structures. These third end cars are generally motor cars, each including at least one motor chain. These third end cars also traditionally each include a driving cabin.

The railway vehicle 10 described above is manufactured during a manufacturing method that will now be described.

The manufacturing method includes producing the first key car 12, having a first structure, and having no dining area.

The method next includes placing the first key car 12, on the corresponding bogies 16.

This first key car 12 is then used as key car for the assembly of the vehicle 10, in a manner known in itself.

Thus, the method includes connecting the first key car 12 with two second cars 20, respectively on either side of this first key car 12, by connecting the connecting means 30 of these second cars 20 with the support means 18 of the respective first end 14 of the first key car 12.

The method next includes, traditionally, adding a plurality of second cars 20, each connected to another second car 20. These second cars 20 are added end to end starting from the first key car 12, each time by connecting the connecting means 30 of these second cars 20 with the support means 18, 28 of the adjacent car.

This assembly is done by mounting each second car on two bogies 16, each bogie 16 being shared by two adjacent cars.

The method lastly includes adding third end cars. These third end cars are each mounted on a respective shared bogie 16, and a personal bogie (not shown).

It will be noted that the invention is not limited to the embodiment previously described and may have various alternatives without going beyond the scope of the claims.

In particular, the first key car 12 could have other layouts, as long as it does not include a dining area.

The invention claimed is:

1. A railway vehicle including a plurality of cars articulated to one another, the plurality of cars comprising:

a single first key car having a first architecture, the first key car configured as the first car placed when assembling the railway vehicle, and mechanically the first car of the vehicle mounted on its bogies, a plurality of second cars, having second architectures similar to one another and different from the first architecture, third end cars, having a third architecture different from the first and second architectures, wherein:

the first key car extends in a longitudinal direction between two first ends, the first architecture comprising, at each first end, a first support for one of the plurality of second cars, each second car extends in a longitudinal direction between two second ends, the second architecture comprising, at one of its second ends, a second support for an additional second car of the plurality of second cars or one of the third end cars, and at the other of its second ends, a connector for connecting to the first or second support of first key car or one of the second cars, each second car adjacent to the first key car includes, at one of its second ends, a bogie shared with the first key car, and at the other of its second ends, a bogie shared with another second car of the plurality of second cars, each additional second car of the plurality of second cars, includes at least at one end, a bogie shared with one of the second cars of the plurality of second cars, wherein the railway vehicle comprises a single dining area having a preparation part, in which food and beverages are stored, prepared by a dining service person, and sold, and a dining part, which is a room arranged specifically for dining, including tables and/or seats, and the single dining area is arranged in one of the second cars of the plurality of second cars, wherein the first support on both ends of the first key car extends below each connector of the respective second car adjacent the first key car such the connector defines a space between the first key car and the respective second car and that a vertical plane extends through the first support, the corresponding connector and between wheels of the shared bogie of the first key car and the respective second car.

2. The railway vehicle according to claim 1, wherein the first key car includes at least one passenger area.

3. The railway vehicle according to claim 1, wherein the first key car includes at least one equipment area.

4. The railway vehicle according to claim 2, wherein the first key car includes at least one equipment area.

5. The railway vehicle according to claim 3, wherein the equipment area comprises a household refrigerating unit.

6. The railway vehicle according to claim 5, wherein the equipment area comprises an air conditioning unit.

7. The railway vehicle according to claim 4, wherein the equipment area comprises a household refrigerating unit.

8. The railway vehicle according to claim 7, wherein the equipment area comprises an air conditioning unit.

9. The railway vehicle according to claim 3, wherein the equipment area comprises an air conditioning unit.

10. The railway vehicle according to claim 4, wherein the equipment area comprises an air conditioning unit.

11. A method for manufacturing a railway vehicle according to claim 1, comprising:

producing a first key car, having a first architecture, with no dining area, the first key car being the first car of the vehicle to be mounted on its bogies, the first key car extending in a longitudinal direction between two first ends, the first architecture comprising, at each first end, a first support for an adjacent second car, producing second cars, having second architectures similar to one another and different from the first architecture, only one of these second cars including a dining area, each second car adjacent to the first key car including, at one end, a bogie shared with the first key car, and at another end, a bogie shared with another second car, and each second car extending in a longitudinal direction between two second ends, the second architecture comprising, at one of its second ends, a second support for another adjacent second car or a third end car, and at the other of its second ends, a connector for connecting to the first or second support of the adjacent first key car or second car, producing third end cars, each having a third architecture different from the first and second architectures, with no dining area, placing the first key car, connecting the first key car with two of the second cars, respectively on either side of this first key car, adding a plurality of other second cars, each connected to another second car, and adding the third end cars.

* * * * *